US009470010B2

(12) United States Patent
Youn

(10) Patent No.: US 9,470,010 B2
(45) Date of Patent: Oct. 18, 2016

(54) COMBINATION TENT

(71) Applicant: Keong Woong Youn, Daegu (KR)

(72) Inventor: Keong Woong Youn, Daegu (KR)

( * ) Notice: Subject to any disclaimer, the term of this patent is extended or adjusted under 35 U.S.C. 154(b) by 0 days.

(21) Appl. No.: 14/716,165

(22) Filed: May 19, 2015

(65) Prior Publication Data

US 2015/0337557 A1 Nov. 26, 2015

(30) Foreign Application Priority Data

May 21, 2014 (CN) ..... 2014 2 0261410

(51) Int. Cl.
*E04H 15/18* (2006.01)
*E04H 15/64* (2006.01)
*E04H 15/32* (2006.01)

(52) U.S. Cl.
CPC ..... *E04H 15/18* (2013.01); *E04H 15/32* (2013.01); *E04H 15/64* (2013.01)

(58) Field of Classification Search
CPC ..... E04H 15/18; E04H 15/646; E04H 15/64; E04H 15/32
USPC ..... 135/97, 117, 119, 120.3, 908, 909
See application file for complete search history.

(56) References Cited

U.S. PATENT DOCUMENTS 1,260,612 A * 3/1918 Whall ..... E04H 15/30 135/117
1,494,050 A * 5/1924 Wittmann ..... E04H 15/00 135/116
2,604,897 A * 7/1952 Cottor ..... B60J 7/104 114/108
3,941,140 A * 3/1976 Beavers ..... E04H 15/32 135/120.3
4,063,566 A * 12/1977 Millerioux ..... E04H 15/18 135/116
4,979,532 A * 12/1990 Johansson ..... E04H 15/64 135/119
5,222,513 A * 6/1993 Hilliard ..... E04H 15/18 135/117
5,394,897 A * 3/1995 Ritchey ..... E04H 15/18 135/117
5,620,396 A * 4/1997 Westphal ..... A63B 9/00 135/97
5,769,106 A * 6/1998 Achuff ..... A41D 15/04 135/95
6,565,405 B2 * 5/2003 Hsu ..... A63B 5/11 446/220
D692,083 S * 10/2013 Toland ..... D21/834
2002/0162584 A1 * 11/2002 Berman ..... E04H 15/006 135/126
2003/0116182 A1 * 6/2003 Ueda ..... E04H 15/20 135/124
2005/0189009 A1 * 9/2005 Walter ..... E04H 15/32 135/97
2013/0174883 A1 * 7/2013 Jin ..... E04H 15/44 135/143

FOREIGN PATENT DOCUMENTS

JP 3-180677 * 8/1991

* cited by examiner

*Primary Examiner* — Robert Canfield
(74) *Attorney, Agent, or Firm* — Rabin & Berdo, P.C.

(57) ABSTRACT

The present invention provides a combination tent comprising a tent gate with lock catches and lock rings, when placed adjacent to a second combination tent, the tent gate of the combination tent is fixedly connected to a tent gate of the second combination tent through the cooperation and connection of the lock catches and the lock rings. The present invention enables quick assembly and disassembly, so that the tent can be used independently or combined with other tents. This connection method is applicable in traditional tents, and rapid assembling tents.

5 Claims, 7 Drawing Sheets

COMBINATION TENT

FIELD OF THE INVENTION

The present invention relates to a tent, in particular, the present invention relates to a combination tent.

BACKGROUND OF THE INVENTION

As the urbanization advances, some people are tired of the city life in the concrete forest, outdoor sports become increasingly popular. Camping is one of the rapidly developing outdoor sports. There are different camping choices to choose from, such as mountain for young people, scenic spots for families. Where the size of the campsite is limited, a tent of a single type usually cannot sufficiently utilize the campsites and the environment, so that different tens have to be used according to different camping routes.

Tents for family camping are usually made of regular materials, and are too heavy to carry. Accordingly, the tents are usually transported by car, and set up at the destination. The cost of these tents is relatively low. Mountain camping tents are usually made of advanced materials, are low in weight and can be used for high mobility outdoor sports. However, the cost of these tents is relatively high.

Tent pole materials presently used include glass fiber, aluminum alloy and carbon fiber. Tubular tent poles made of glass fiber are currently mostly used. The tent poles can be folded, and the sections of the tent poles are assembled by elastic rope. To enhance the strength, both ends of each section of the tent pole are provided with aluminum alloy. The tent poles are slightly soft and elastic, but they can be easily broken when in low temperature condition, once the tent poles break, the tent cannot be effectively supported. Aluminum alloy tent poles are also popular in the market. They are assembled similar to the glass fiber tent poles. The aluminum alloy tent poles have similar weight, but better strength and durability. Even in low temperature environment, they have better support property. Carbon fiber tent poles have low weight, the durability is best among the tent poles, they work excellent in low temperature environment, but are most expensive.

Based on the appearance and the capacity of the tents, tents are customarily categorized into single tent, twin tent, four-person tent, five-person tent, six-person tent, eight-person tent. Of course there are tents that can accommodate more people. However, existing tents are used individually, they cannot be used in combination.

SUMMARY OF THE INVENTION

The object of the present invention is to provide a combination tent to solve the technical problems of existing tents.

The technical proposal provided by the present invention is as follows:

A combination tent comprising a tent gate with lock catches and lock rings, when placed adjacent to a second combination tent, the tent gate of the combination tent is fixedly connected to a tent gate of the second combination tent through the cooperation and connection of the lock catches and the lock rings.

In another preferred embodiment, each of the lock catches comprises a connecting column and a small cross bar; one end of the connecting column is fixedly connected to the side of the tent gate, the other end of the connecting column is vertically connected to a center of the small cross bar; the lock ring comprises a second connecting column and a ring body, one end of the second connecting column is fixedly connected to the side of the tent gate, the other end is connected to the ring body.

In another preferred embodiment, the combination tent is triangular cone shaped, quadrate cone shaped, pentagonal cone shaped or hexagonal cone shaped.

In another preferred embodiment, the tent gate is chevron shaped, two sides of the chevron tent gate have equal length, each side is disposed with a plurality of lock catches or lock rings.

A second technical proposal of the present invention is that:

A combination tent comprising a tent gate with lock catches and lock rings, wherein the tent gate defines an external edge, the external edge including a hemline, the lock catches or lock rings are disposed on an inner side of the hemline; the tent gate further comprises a connecting band, the lock catches or the lock rings are disposed on an edge of the connecting band for connecting to the tent gate; wherein when placed adjacent to a second combination tent, the tent gate of the combination gate is placed in close proximity to a tent gate of the second combination tent, the combination tent and the second combination tent are connected by the connecting band, and through the cooperation and connection of the lock catches and the lock rings.

In another preferred embodiment, each of the lock catches comprises a connecting column and a small cross bar; one end of the connecting column is fixedly connected to the side of the tent gate, the other end of the connecting column is vertically connected to a center of the small cross bar; the lock ring comprises a second connecting column and a ring body, one end of the second connecting column is fixedly connected to the side of the tent gate, the other end is connected to the ring body.

In another preferred embodiment, the combination tent is triangular cone shaped, quadrate cone shaped, pentagonal cone shaped or hexagonal cone shaped.

In another preferred embodiment, the tent gate is chevron shaped, two sides of the chevron tent gate have equal length, each side is disposed with a plurality of lock catches or lock rings.

In another preferred embodiment, the lock rings are disposed on the connecting portion of the tent gate and the hemline; the external edge of the hemline is disposed with Velcro or equivalent hook and loop fastener, the inner side of the lock ring or lock catch in the connecting band is correspondingly disposed with Velcro or equivalent hook and loop fastener, the connecting portion of the connecting band and the tent form double connections.

In another preferred embodiment, the connecting band is a tent door, when served as a single tent, the connecting band is the tent door closing to the tent gate.

A third technical proposal of the present invention is that:

A combination tent comprising two single tents, each of the single tents comprising a tent gate with lock catches and a tent gate with lock rings, wherein between two adjacent single tents, the tent gate with the lock catches is placed in close proximity to the tent gate with the lock rings, two tent gates of the two adjacent single tents are fixedly connected through the cooperation and connection of the lock catches and the lock rings.

The present invention has following advantages:

1. With the cooperation and connection of the lock catches and lock rings, two tent gates of two adjacent tents are fixedly connected, so that the tent can be used on its own, or combined with another one.

2. when the campsite space is limited (for example on the mountain top, or a locality with limited flat ground suitable to put up tent), when combining the tents of the present invention, it can effectively use the campsite and the locality, one tent gate is used for people to get in and out.
3. On a rainy day, travelers can gather to one tent through the connected tent gates without wearing rain gears like waterproof jackets, to play games such as card games.
4. The tents are close to each other, which makes people feel safe in the field in the night.

The present invention will be further described with the drawings and embodiments; it should be noted that the scope of the combination tent of the present invention is not limited to the embodiments.

DETAILED DESCRIPTION OF THE EMBODIMENTS

The First Embodiment

Figure 1:
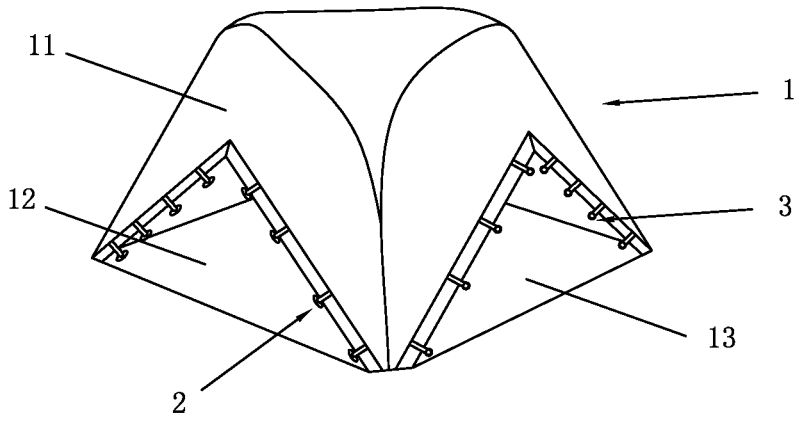
FIG. 1 is a schematic diagram of a single tent of the first embodiment.
Figure 2:
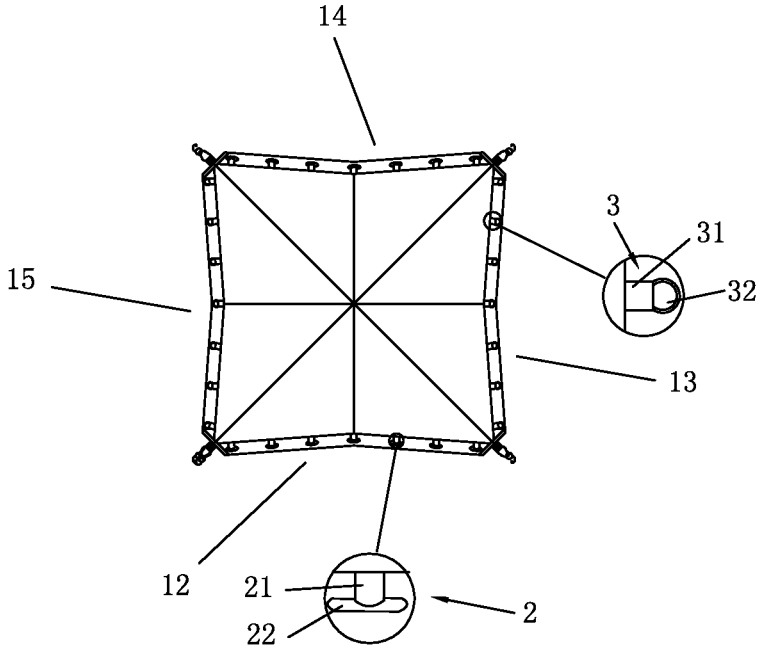
FIG. 2 illustrates a top view of the single tent of the first embodiment and a partial enlargement diagram.

Referring to FIG. 1 and FIG. 2, the combination tent comprises at least two single tents 1, each single tent 1 is quadrate cone shaped, four sides of the outer tent 11 are respectively disposed with chevron shaped tent gates 12, 13, 14, 15.

Lock catches 2 are disposed on two sides of the chevron shaped tent gates 12, 14. Each lock catch 2 has a connecting column 21 and a small cross bar 22, one end of the connecting column 21 is fixed to the side, the other end is vertically connected to the center of the small cross bar 22.

Lock rings 3 are disposed on two sides of the chevron shaped tent gates 13, 15. Each lock ring 3 comprises a connecting column 31 and a ring body 32, one end of the connecting column 31 is fixed to the side, the other end is connected to the ring body 32.

Figure 3:
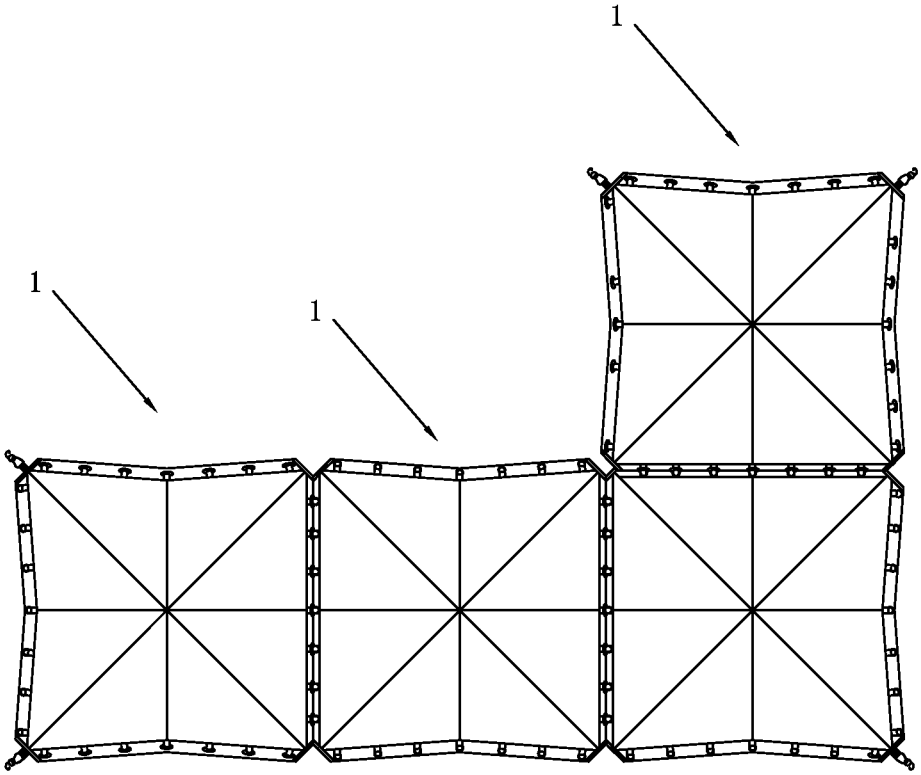
FIG. 3 illustrates a top view of combined tents of the first embodiment.

Referring to FIG. 3, four tents 1 are combined to be L shaped. Tent gate with lock catches 2 and tent gate with lock rings 3 between two adjacent tents 1 are placed adjacent to each other, with the cooperation and connection of the lock catches 2 and lock rings 3, two adjacent tents 1 are connected. In addition, waterproof hemlines can be disposed on the tent gate to prevent water leak through the connecting portion.

In this embodiment, the single tent 1 is quadrate cone shaped. Triangular cone shaped, pentagonal cone shaped or hexagonal cone shaped tent also can be implemented as needed.

The Second Embodiment

Figure 4:
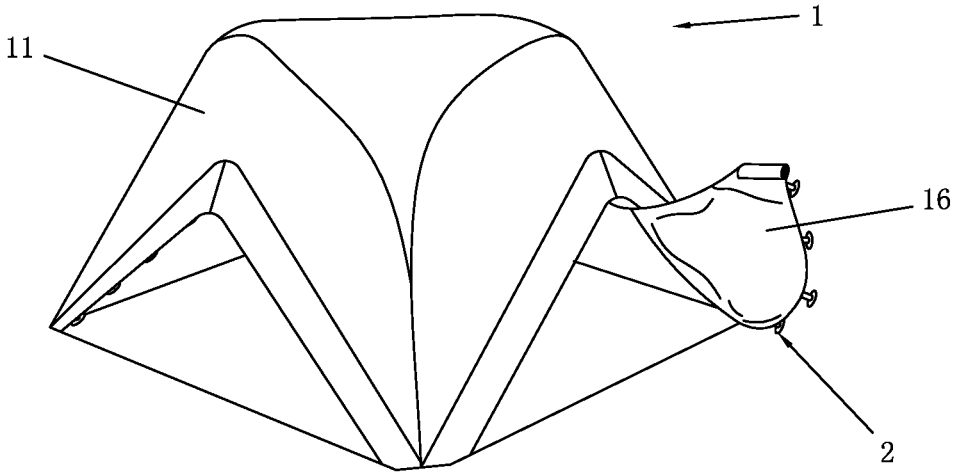
FIG. 4 illustrates a schematic diagram of a single tent of the second embodiment.
Figure 5:
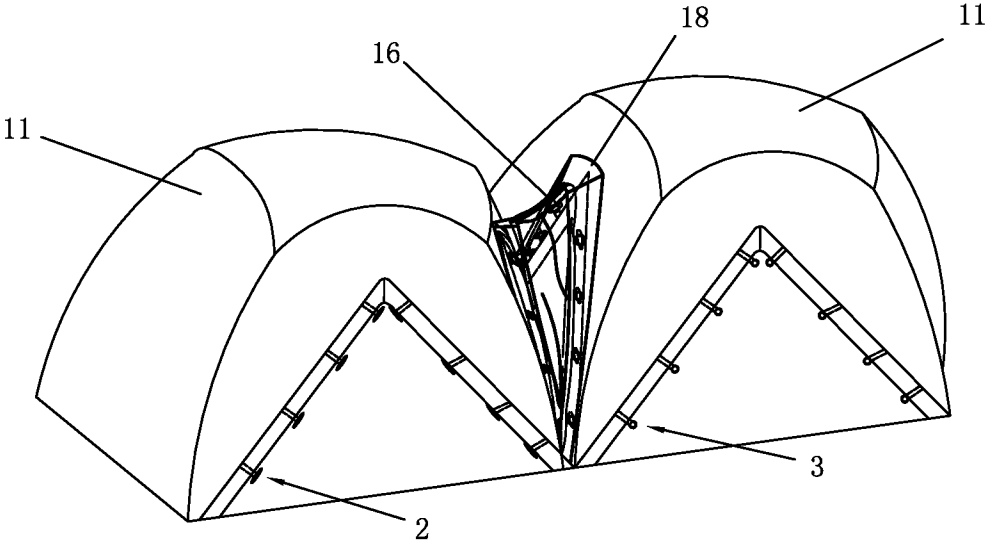
FIG. 5 illustrates a schematic diagram of combined tents of the second embodiment.

Referring to FIG. 4 and FIG. 5, a combination tent comprises at least two single tents 1, the single tent 1 is disposed with a tent gate 12, or two tent gates 12 on two adjacent sides. The external edge of the tent gate 12 is disposed with a hemline 18, the inner side of the hemline 18 is disposed with lock catches 2 or lock rings 3. The hemline further comprises a connecting band 16, the edge of the connecting bend 16 is disposed with lock ring 3 or lock catch to connect to the tent gate 12. As described, there are two tent gates 12 disposed at the adjacent sides of the external tent 11 of the single tent 1. As needed, there can be three tent gates, or that the number of the tent gates 12 of different single tents 1 can be disposed differently, these configurations are simple replacement according to the embodiment, and will not be further discussed.

In this embodiment, the connecting band 16 is a tent door, two tent gates 12 of two adjacent tents 1 are near to each other, the connection of the lock catch 2 at the lock door of one tent 1 and the lock ring 3 at the tent gate 12 of another tent forms one side of the tent passage, another side of the tent passage is formed in the same way.

The single tent 1 can be used on its own as a single product, in this case, the connecting band 16 is served as a tent door and closes the tent gate 12.

The tent gate 12 is chevron shaped with two sides of equal sides, each side is disposed with a plurality of lock catches 2 and lock rings 3. The lock catch 2 comprises a connecting column 21 and a small cross bar 22, one end of the connecting column 21 is fixed to the side of the tent gate 12, and the other end is vertically connected to the center of the small cross bar. The lock ring 3 comprises a connecting column 31 and a ring body 23, one end of the connecting column 31 is fixed to the side of the tent gate 12, the other end is connected to the ring body 23.

In this embodiment, a hemline 18 is disposed at the external edge of the tent gate 12, the inner side of the hemline 18 is disposed with lock catch 2 or lock ring. The edge of the connecting band is disposed with lock ring 3 or lock catch 2 connected to the tent gate 12.

In this embodiment, the hemline 18 is waterproof, the external edge of the hemline 18 is disposed with Velcro or equivalent hook and loop fastener 4, the inner side of the lock ring 3 or lock catch 2 of the connecting band 16 is correspondingly disposed with Velcro or equivalent hook and loop fastener 4, the connecting portion of the connecting band 16 and the tent form double connections, so that the hemline 18 can fully cover the gap between the connecting portion of the lock catch 2 and lock ring 3, thus achieving waterproof effect.

The Third Embodiment

Figure 6:
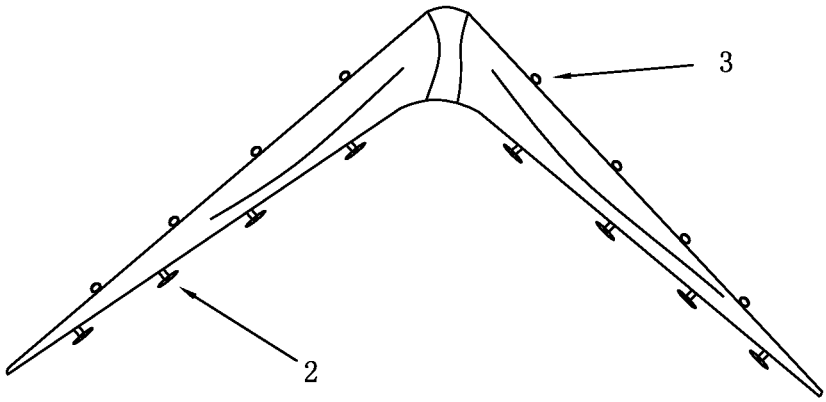
FIG. 6 illustrates a schematic diagram of a connecting band of the third embodiment.
Figure 7:
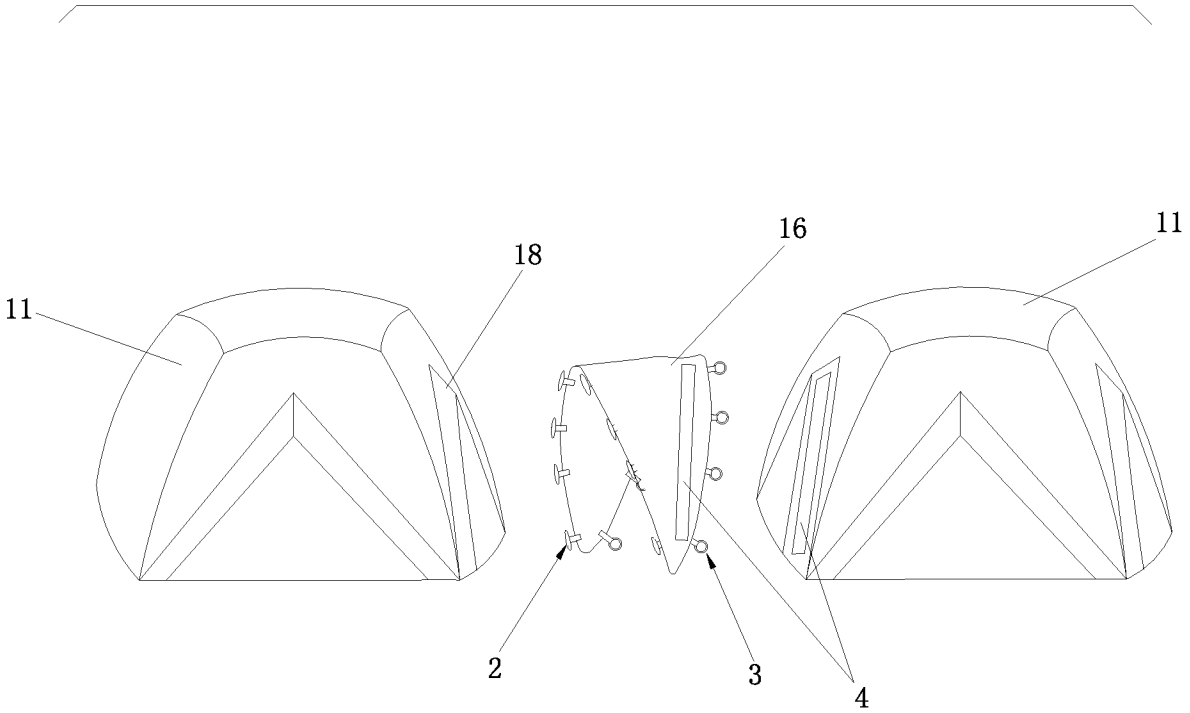
FIG. 7 illustrates a schematic diagram of tents before combining of the third embodiment.
Figure 8:
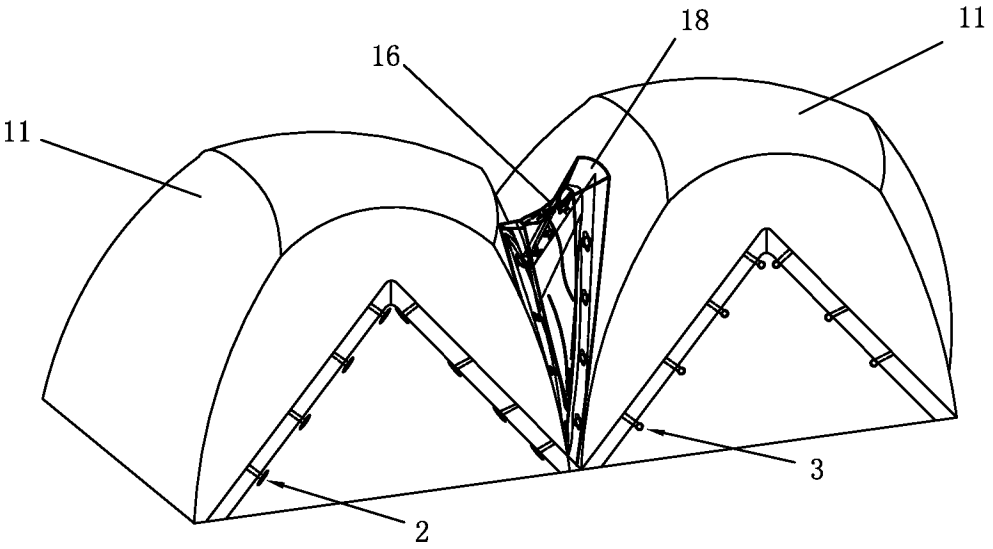
FIG. 8 illustrates a schematic diagram of combined tents of the third embodiment.

Referring to FIGS. 6-8, the combination tent comprises at least two single tents 1, the single tent 1 has a tent gate 12, or two tent gates 12 on two adjacent sides. Hemline 18 is disposed on the external edge of the tent gate 12. Lock catch 2 or lock ring 3 are disposed on the inner side of the hemline 18. The hemline 18 further comprises a connecting band 16, the edge of the connecting band 16 is disposed with lock ring 3 or lock catch 2 to connect to the tent gate 12.

The connecting band 16 is a connection cloth, one side thereof is disposed with lock catch 2 with the same number as the lock ring 3 on the side of the tent gate 12 of a single tent 1. The other side is disposed with lock ring 3 with the same number as the lock catch on the side of the tent gate 12 of another single tent 1, with cooperation and connection of the lock catch or lock ring 3 of the side of the tent gate 12 and the lock ring 3 or lock catch 2 of the connection cloth, two adjacent single tents 1 can be connected.

In this embodiment, the external edge of the tent gate 12 is disposed with hemline 18, the inner side of the hemline 18 is disposed with lock catch 2 or lock ring 3, the edge of the connecting band is disposed with lock ring 3 or lock catch 2 to connect to the tent gate 12.

In this embodiment, the hemline 18 is waterproof, the external edge of the hemline 18 is disposed with Velcro or equivalent hook and loop fastener 4, the inner side of the lock ring 3 or lock catch 2 of the connecting band 16 is correspondingly disposed with Velcro or equivalent hook and loop fastener 4, the connecting portion of the connecting band 16 and the tent form double connections, so that the hemline 18 can fully cover the clearance of the connecting portion of the lock catch 2 and lock ring 3, thus achieving waterproof effect.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

What is claimed is:

1. A first combination tent having tent gates, lock catches, lock rings, wherein each tent gate defines an external edge, the external edge including a hemline having at least one of lock catches and lock rings, the lock catches or lock rings are disposed on an inner side of the hemline; the external edge of the hemline is disposed with hook and loop type fastener; each tent gate further comprises a connecting band having a least one of lock catches and lock rings disposed on an edge of the connecting band for connecting to a tent gate; wherein when placed adjacent to a second combination tent, a tent gate of the first combination tent is placed in close proximity to a tent gate of the second combination tent, the first combination tent and the second combination tent are connected by the connecting band, and through the cooperation and connection of the lock catches and the lock rings; wherein lock rings are disposed on a connecting portion of the tent gates which includes the hemline; the inner side of the lock ring or lock catch in the connecting band is correspondingly disposed with hook and loop type fastener, the connecting portion of the connecting band and the tent form double connections.

2. The combination tent according to claim 1, wherein each of the lock catches comprises a connecting column and a small cross bar; one end of the connecting column is fixedly connected to the side of the tent gate, the other end of the connecting column is vertically connected to a center of the small cross bar; the lock ring comprises a second connecting column and a ring body, one end of the second connecting column is fixedly connected to the side of the tent gate, the other end is connected to the ring body.

3. The combination tent according to claim 1, wherein the combination tent is triangular cone shaped, quadrate cone shaped, pentagonal cone shaped or hexagonal cone shaped.

4. The combination tent according to claim 1, wherein the tent gate is chevron shaped, two sides of the chevron tent gate have equal length, each side is disposed with a plurality of lock catches or lock rings.

5. The combination tent according to claim 1, wherein the connecting band is a tent door, when served as a single tent, the connecting band is the tent door closing to the tent gate.

* * * * *